US007652646B2

(12) United States Patent
Lin

(10) Patent No.: US 7,652,646 B2
(45) Date of Patent: Jan. 26, 2010

(54) SYSTEMS FOR DISPLAYING IMAGES INVOLVING REDUCED MURA

(75) Inventor: Ching-Wei Lin, Tou-Yuan (TW)

(73) Assignee: TPO Displays Corp. (TW)

( * ) Notice: Subject to any disclaimer, the term of this patent is extended or adjusted under 35 U.S.C. 154(b) by 649 days.

(21) Appl. No.: 11/404,321

(22) Filed: Apr. 14, 2006

(65) Prior Publication Data

US 2007/0241999 A1 Oct. 18, 2007

(51) Int. Cl.
*G09G 3/30* (2006.01)

(52) U.S. Cl. ..... 345/76; 345/77; 345/78; 345/79; 345/80; 345/81; 345/82; 345/83; 345/84; 345/204

(58) Field of Classification Search ..... 345/76–84, 345/204
See application file for complete search history.

(56) References Cited

U.S. PATENT DOCUMENTS

2002/0196213 A1* 12/2002 Akimoto et al. ..... 345/82
2003/0067424 A1* 4/2003 Akimoto et al. ..... 345/55
2004/0196221 A1* 10/2004 Shih ..... 345/82

FOREIGN PATENT DOCUMENTS

CN 1517964 8/2004
EP 1 439 520 7/2004

OTHER PUBLICATIONS

Hiroshi Kageyama et al, "9.1: A3.5-inch OLED Display using a 4-TFT Pixel Circuit with an Innovative Pixel Driving Scheme", SID International Symposium Digest of Technical Papers vol. 34/1, pp. 96- 99, date 2003.
English Abstract of Chinese Patent Application No. 1517964.

* cited by examiner

*Primary Examiner*—Richard Hjerpe
*Assistant Examiner*—Saifeldin Elnafia
(74) *Attorney, Agent, or Firm*—Thomas, Kayden, Horstemeyer & Risley, LLP.

(57) ABSTRACT

Systems for displaying images are provided. A representative system incorporates a display device that includes a data line operative to provide display signals and sweep signals; a scan line operative to provide scan reset signals; a first capacitor having a first end coupled to the data line for storing charges from the signal line; a first inversion unit having an input end coupled to a second end of the first capacitor, a first supply end coupled to a first voltage source, a second supply end coupled to a second voltage source larger than the first voltage, and an output end; a first reset switch having a first end coupled between the second end of the first capacitor and the input end of the first inversion unit, a second end coupled to the output end of the first inversion unit, and a control end coupled to the scan line; a driving TFT having a control end coupled to the output end of the first inversion unit; and an illuminating unit coupled between a first end of the driving TFT and a third voltage source larger than or equal to the first voltage source.

16 Claims, 14 Drawing Sheets

SYSTEMS FOR DISPLAYING IMAGES INVOLVING REDUCED MURA

BACKGROUND OF THE INVENTION

1. Field of the Invention

The present invention relates to display devices.

2. Description of the Prior Art

With rapid development of planar displays, more and more planar display technologies are being researched for increasing product competitiveness. In order to meet the needs of demanding applications, the flat panel industry is now looking at displays known as active-matrix organic light emitting displays (AMOLEDs). An AMOLED has an integrated electronic back plane as its substrate and is particularly suitable for high-resolution, high-information content applications including videos and graphics. This form of display is made possible by the development of polysilicon technology, which, because of its high carrier mobility, provides thin-film-transistors (TFTs) with high current carrying capability and high switching speed. In an AMOLED display, each individual pixel can be addressed independently via the associated driving thin-film transistors (TFTs) and capacitors in the electronic back plane.

FIG. 1 shows a configuration of a prior art AMOLED 10. The AMOLED 10 includes a plurality of pixels 100 arranged in a matrix manner, and only one pixel is shown in FIG. 1 for simplicity. The pixels 100, each including an organic light emitting diode (OLED) 102 as a pixel light emitting device, are coupled to voltage sources VDD and VEE, and to external driving circuits via corresponding gate lines 12 and data lines 14. Each pixel 100 further includes a storage capacitor 104, an n-type control TFT 106, and a p-type driving TFT 108. In each pixel 100, a gate and a drain of the control TFT 106 is coupled to the gate line 12 and the data line 14, respectively, while a gate and a source of the driving TFT 108 is coupled to a source of the control TFT 106 and the voltage source VDD, respectively. The storage capacitor 104 is coupled between the gate and the source of the driving TFT 108. The OLED 102 is coupled between a drain of the driving TFT 108 and the voltage source VEE.

An operation of the AMOLED 10 will be described. First, a gate signal is generated by an external gate driving circuit and sent to the gate line 12 for switching on the control TFT 106. Then, a signal voltage that has been supplied from an external data driving circuit to the data line 14 is input to the gate of the driving TFT 108 and to the storage capacitor 104 via the turned-on control TFT 106. The driving TFT 108 supplies a driving current according to the signal voltage to the OLED 102, causing it to illuminate in response to the signal voltage.

As well-known to those skilled in the art, a TFT has three working modes: cut-off, linear, and saturation. For example, the drain current of an n-type TFT can be represented by the following formulae:

$$Id_off=0, \text{ when } Vgs<Vth \tag{1}$$

$$Id_linear=\mu C_{OX}W_{eff}L_{eff}[(Vgs-Vth)Vds-Vds^2/2], \text{ when } 0<Vds<Vgs-Vth \tag{2}$$

$$Id_sat=[\mu C_{OX}W_{eff}L_{eff}(Vgs-Vth)^2]/2, \text{ when } 0<Vgs-Vth<Vds \tag{3}$$

where μ is the effective surface mobility of the carriers;

$C_{OX}$ is the gate oxide capacitance;

$W_{eff}$ is the effective channel width;

$L_{eff}$ is the effective channel length;

Vgs is the voltage established between the gate and the source of the TFT;

Vds is the voltage established between the drain and the source of the TFT;

Vth is the threshold voltage of the TFT;

Id_off is the drain current when the TFT works in the cut-off mode;

Id_linear is the drain current when the TFT works in the linear region;

Id_sat is the drain current when the TFT works in the saturation region.

Regardless of doping types, when a transistor begins to conduct depends on its threshold voltage Vth, which is characterized by the gate conductor/insulator material, the thickness of gate oxide material and the channel doping concentration. The threshold voltage Vth of a TFT can deviate from its typical voltage setting for various reasons, such as due to process variations or changes of operational environment. FIG. 2 shows a current-voltage (I-V) curve of the driving TFT 108 and the OLED 102. In FIG. 2, a curve A represents the I-V curve of the OLED 102, a curve B represents the I-V curve of the driving TFT 108 with a nominal threshold voltage Vth, and curves B' and B" represent the I-V curves of the driving TFT 108 when the threshold voltage deviates from the nominal value Vth to Vth' and Vth", respectively. As shown in FIG. 2, the designed operational point S (indicated by "" in FIG. 2) of the OLED 102 can shift to points S' and S" (indicated by "X" in FIG. 2) with threshold voltage deviations. As represented by the formula (1), the luminance of the OLED 102 depends largely on the threshold voltage Vth of the driving TFT 108, whose I-V characteristic is a function of the threshold voltage Vth raised to the second power when working in the saturation region. The pixels 100 can have irregular display uniformity (mura) when displaying images of the same gray scale if the threshold voltages Vth of the corresponding driving TFTs 108 deviate from the nominal value. Therefore, the prior art AMOLED 10 has poor display uniformity even with slight variation of TFT characteristics.

SUMMARY OF THE INVENTION

Systems for displaying images are provided. In this regard, an exemplary embodiment of such as system comprises a display device comprising a data line operative to provide display signals and sweep signals; a scan reset line operative to provide scan reset signals; a first capacitor having a first end coupled to the data line for storing charges from the signal line; a first inversion unit having an input end coupled to a second end of the first capacitor, a first supply end coupled to a first voltage source, a second supply end coupled to a second voltage source larger than the first voltage, and an output end; a first reset switch having a first end coupled between the second end of the first capacitor and the input end of the first inversion unit, a second end coupled to the output end of the first inversion unit, and a control end coupled to the scan reset line; a driving TFT having a control end coupled to the output end of the first inversion unit; and an illuminating unit coupled between a first end of the driving TFT and a third voltage source larger than or equal to the first voltage source.

Another exemplary embodiment of such as system comprises a display device comprising a first data line operative to provide display signals; a second data line operative to provide sweep signals; a scan line operative to provide scan signals; a control switch having a control end coupled to the scan line, and a first end coupled to the first data line; a capacitor coupled between the second data line and a second end of the control switch and operative to store charges from the first or second data line; an inversion unit having an input end coupled to the capacitor, a first supply end coupled to a first voltage source, a second supply end coupled to a second voltage source, and an output end; a driving TFT having a control end coupled to the output end of the inversion unit; and an illuminating unit coupled between a first end of the driving TFT and a third voltage source larger than or equal to the first voltage source.

Another exemplary embodiment of such as system comprises a pixel, a data line and a scan reset line. The pixel has a driving TFT, with the driving TFT being operative to control illumination of the pixel. The data line is operative to provide display signals and sweep signals to the pixel. The scan reset line is operative to provide scan reset signals to the pixel. The driving TFT has a linear region and a saturation region, and the driving TFT exhibits an operating point within the linear region.

DETAILED DESCRIPTION

Figure 1:
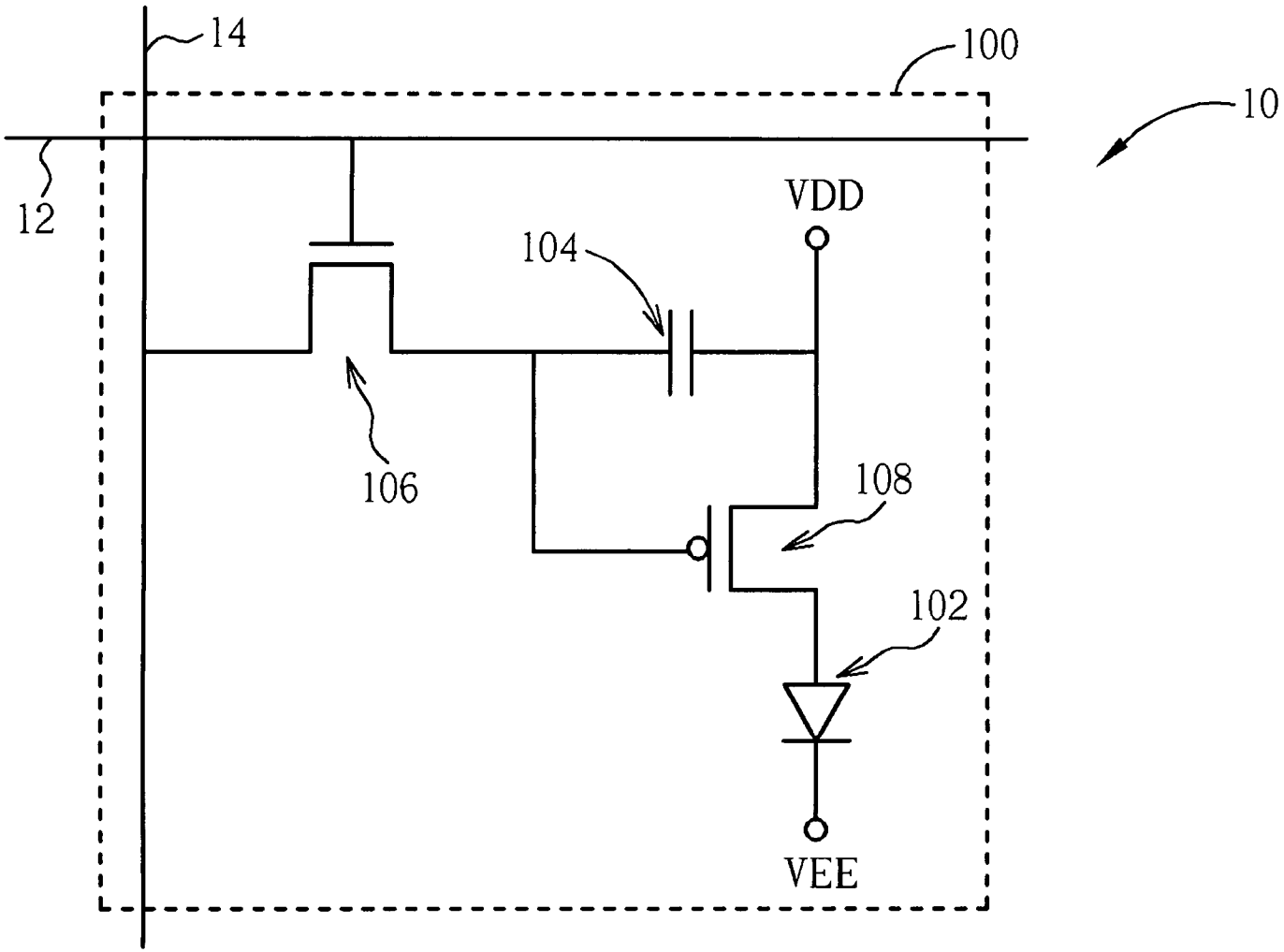
Fig. 1 Prior art
FIG. 1 shows a prior art AMOLED.
Figure 2:
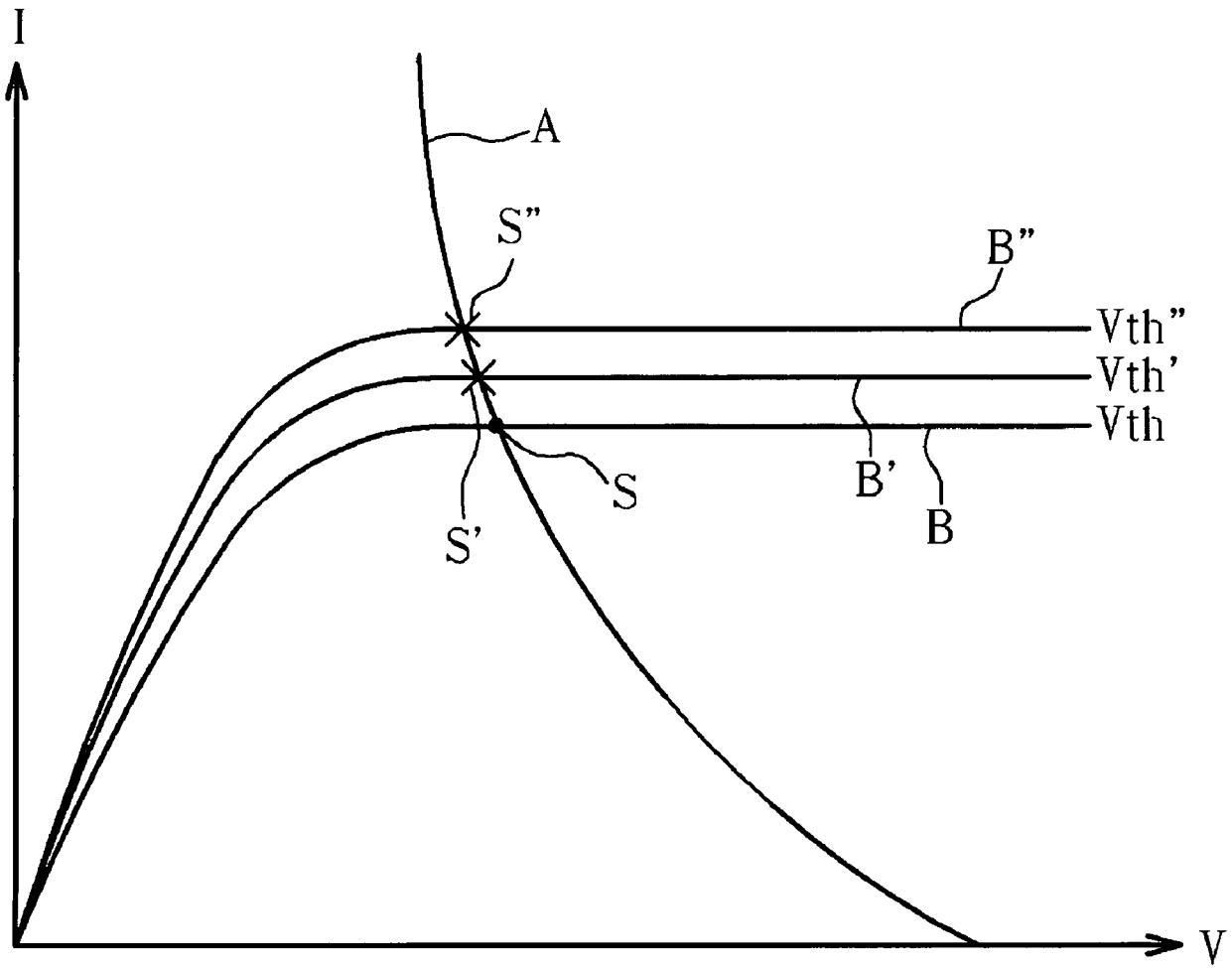
Fig. 2 Prior art
FIG. 2 shows an I-V curve of the driving switch and the OLED in the prior art AMOLED of FIG. 1.
Figure 3:
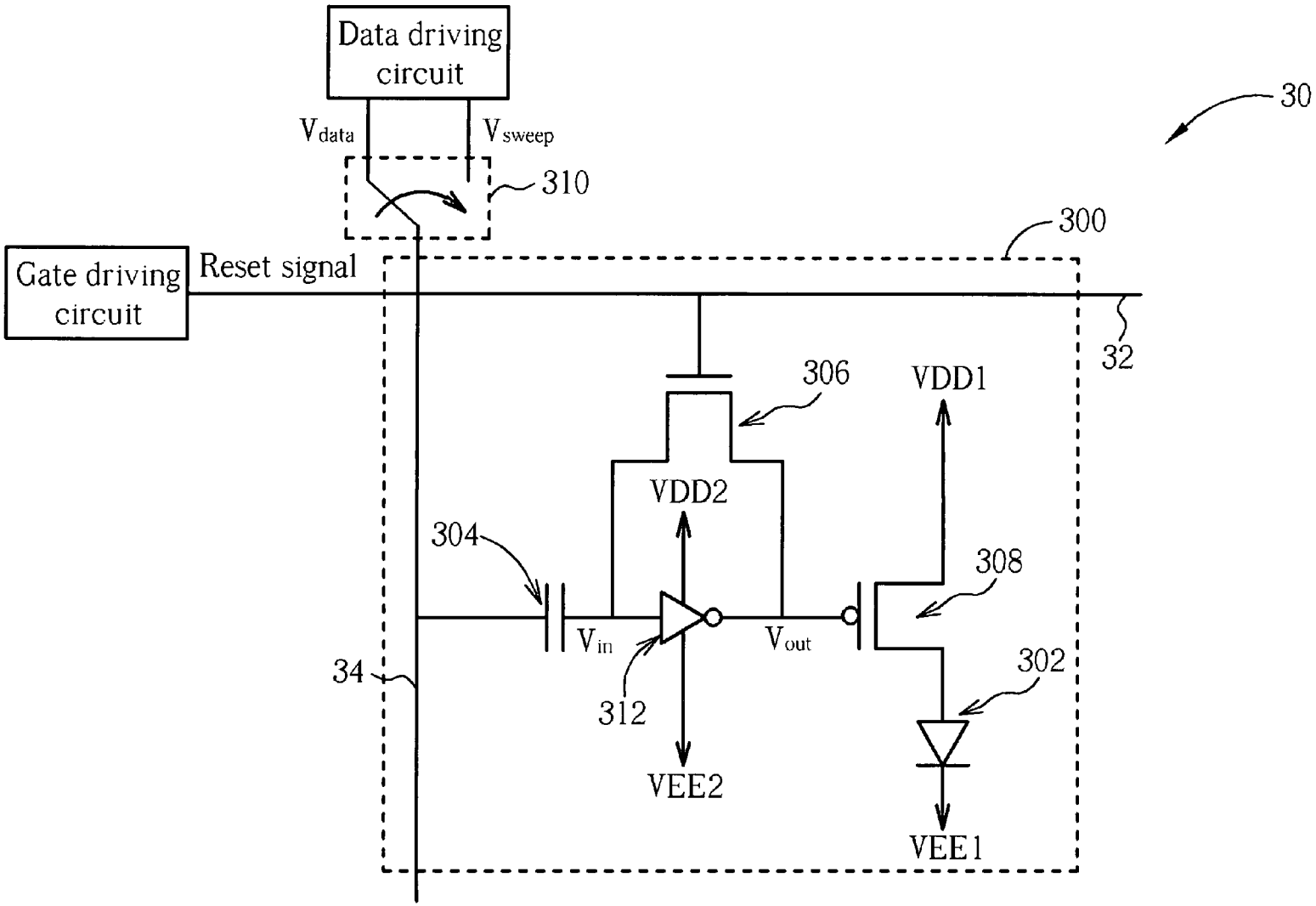
FIG. 3 shows an embodiment of a system for displaying images that includes an AMOLED.

FIG. 3 shows an embodiment of a system for displaying images that includes an active matrix organic light emitting display (AMOLED) 30. The AMOLED 30 includes a plurality of pixels 300 arranged in a matrix manner, and only one pixel is shown in FIG. 3 for simplicity. The pixels 300, each including an organic light emitting diode (OLED) 302 as a pixel light emitting device, are coupled to external driving circuits via corresponding scan reset lines 32 and data lines 34. Each pixel 300 further includes a storage capacitor 304, a reset switch 306, a driving TFT 308, and an inversion unit 312. The reset switch 306, coupled between an input end and an output end of the inversion unit 312, is either turned on (short-circuited) or turned off (open-circuited) based on reset signals received from the scan reset line 32. The voltages established at the input and output ends of the inversion unit are designated as $V_{in}$ and $V_{out}$, respectively. The storage capacitor 304, coupled between the data line 34 and the input end of the inversion unit 312, stores charges of data signals $V_{data}$ via a relay switch 310. The driving TFT 308 can include a p-type TFT having a gate coupled to the output end of the inversion unit 312 and a source coupled to a voltage source VDD1. The OLED 302 is coupled between a drain of the driving TFT 308 and a voltage source VEE1. The inversion unit 312 also includes a first and a second supply end coupled to voltage sources VDD2 and VEE2, respectively. The reset signals can be generated by an external gate driving circuit, such as one commonly known to those skilled in the art, for example, and the data signals and the sweep signals can be generated by an external data driving circuit, such as one commonly known to those skilled in the art, for example.

Figure 4:
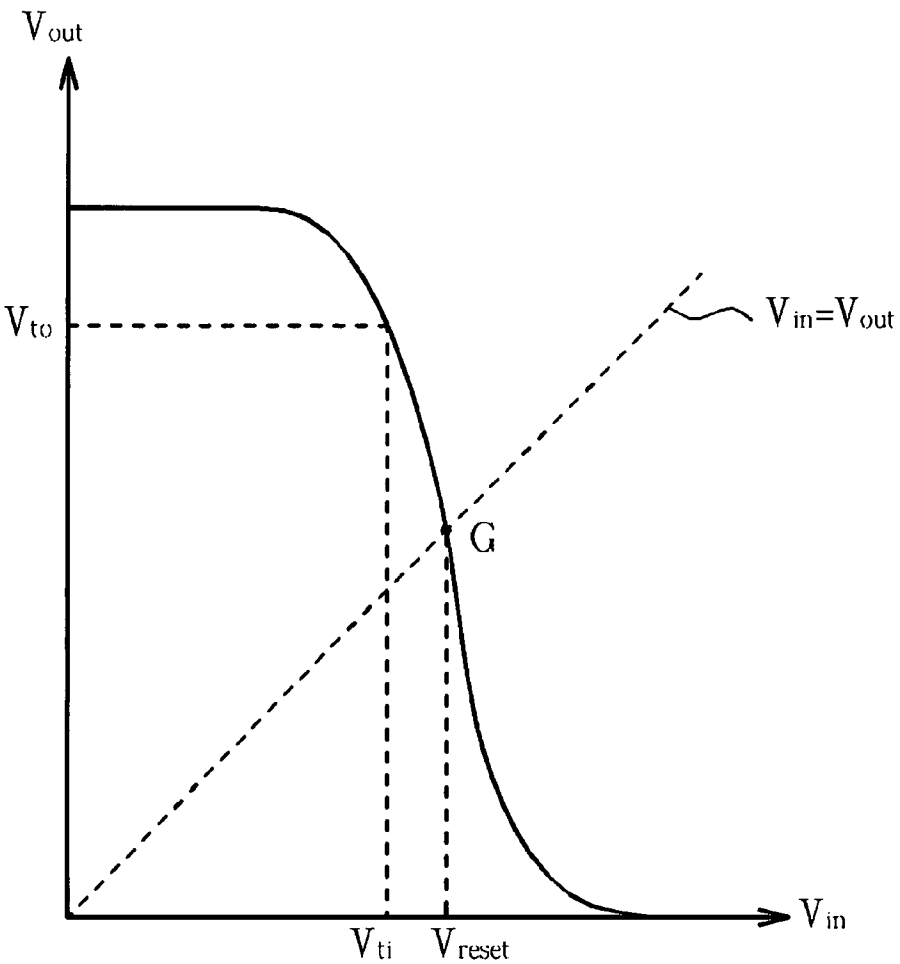
FIG. 4 shows an input voltage-output voltage characteristic of the inversion unit in the AMOLED of FIG. 3.

FIG. 4 shows an input voltage-output voltage ($V_{in}$-$V_{out}$) characteristic of the inversion unit 312, in which a solid curve represents the voltage characteristic. $V_{to}$ represents a turn-on voltage of the driving TFT 308 obtained at the output end of the inversion unit 312, and $V_{ti}$ represents a corresponding input voltage at the same time. When the reset switch 306 is turned on, $V_{in}$ and $V_{out}$ of the inversion unit 312 become equal. A dot marked as "G" in the figure represents a starting operation point and the input/output voltage is reset to $V_{reset}$, which represents a logic inversion threshold in the inverter voltage characteristic. Ideally, the output voltage $V_{out}$ of the inversion unit 312 immediately switches between high or low levels based on whether the value of $V_{in}$ exceeds $V_{reset}$. However in reality, the transition period of the voltage curve does not have an infinite slope as desired. In order to achieve fast switching operations, it is preferable to make the rise/drop characteristic of the inversion unit 312 sufficiently steep, so that the values of $V_{reset}$ and $V_{ti}$ are very close to each other and can be regarded approximately as the same voltage.

Figure 5:
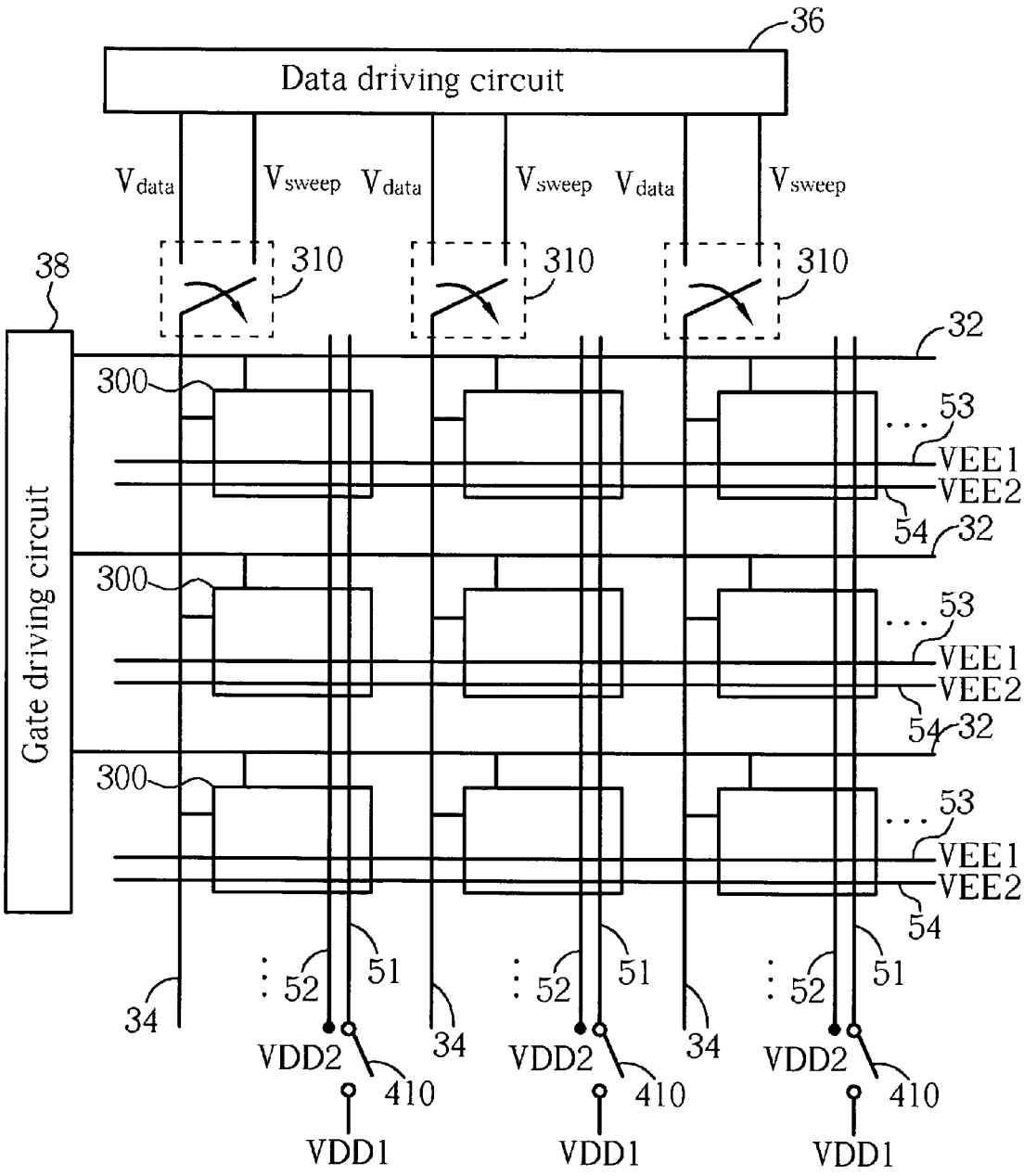
FIG. 5 shows the matrix of the AMOLED of FIG. 3.

FIG. 5 shows the matrix of the AMOLED 30 according to the first embodiment of the present invention. The AMOLED 30 shown in FIG. 5 includes a data driving circuit 36, a gate driving circuit 38, a plurality of data lines 34, a plurality of scan reset lines 32, and a plurality of pixels 300. Power lines 51-54 are used to respectively provide power from the voltage sources VDD1, VDD2, VEE1 and VEE2 to each pixel 300. The voltage source VDD1 supplies voltages to the pixels 300 via corresponding switches 410. The relay switches 310 control passages of the data signal $V_{data}$ and the sweep signal $V_{sweep}$ from the data driving circuit 36 into corresponding data lines 34.

Figure 6:
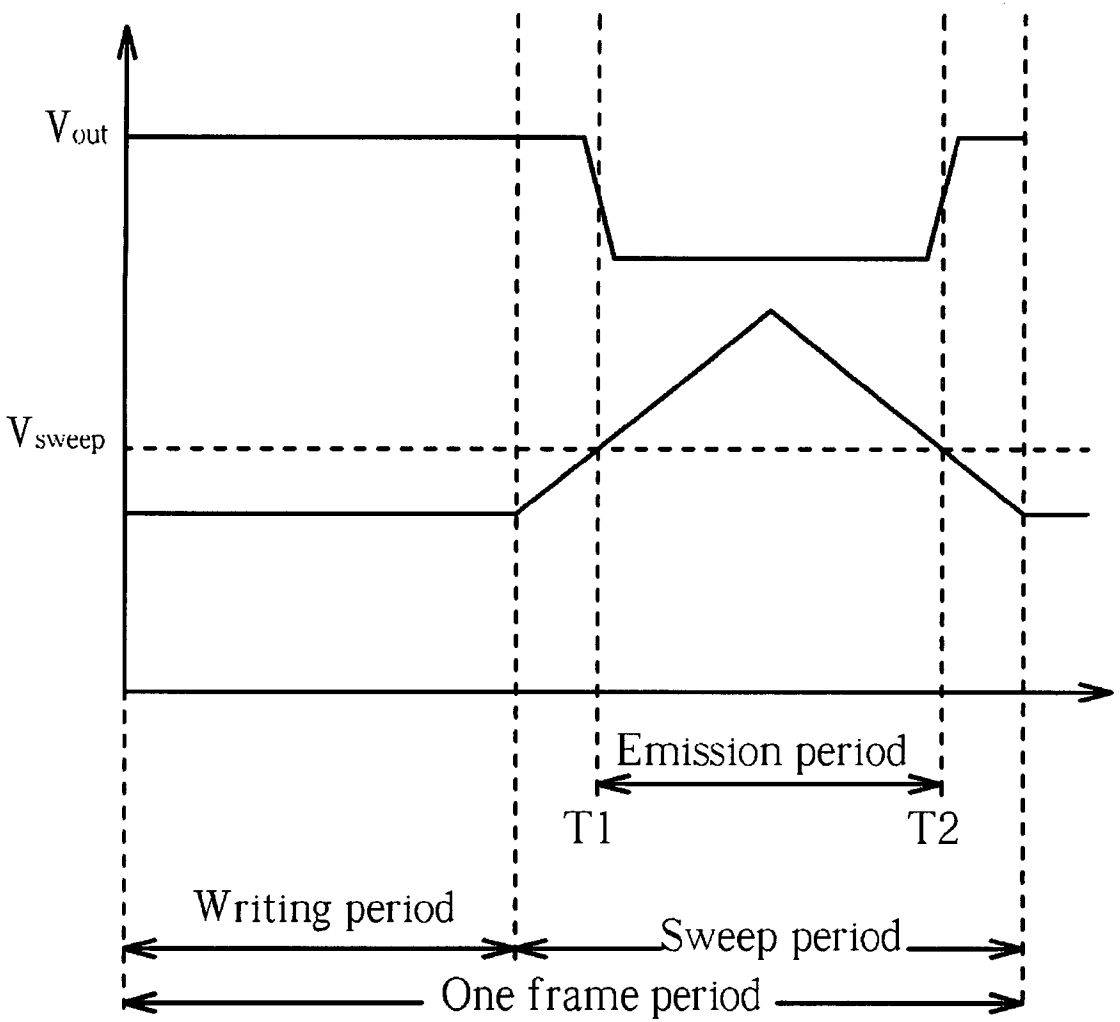
FIG. 6 shows a timing diagram illustrating the overall operation of the first embodiment during a frame period.

FIG. 6 shows a timing diagram illustrating the overall operation of the first embodiment during a frame period. $V_{out}$ represents the voltage level at the output end of the inversion unit 312, and $V_{sweep}$ represents the voltage level of a sweep signal. Normally, a triangular pixel driving voltage as shown in FIG. 6 is used for the sweep signal.

The first half of the frame period is a "writing period" of a display signal. During the writing period, the switches 410 are open-circuited, thereby disconnecting the pixels 300 from the voltage source VDD1. First, the scan reset line 32 goes high and turns on the reset switches 306 of the pixels 300, thereby setting both the input and output voltages of the inversion units 312 to $V_{reset}$. Then, the reset switches 306 are turned off and predetermined display signal voltages $V_{data}$ corresponding to a display image are input into the data lines 34 sequentially and applied to one end of the corresponding storage capacitor 304. Therefore, a voltage difference between a signal voltage $V_{data}$ and the voltage $V_{reset}$ is stored in each storage capacitor 304 and the output voltage of the inversion unit 312 remains at a high level.

The second half of the frame period is a "sweep period". During the sweep period, the switches 410 are short-circuited, connecting the pixels 300 to the voltage source VDD1. Since the input and output ends of each inversion unit 312 are not electrically connected via the reset switches 306 when the reset switches 306 are turned off, the input voltage $V_{in}$ of each inversion unit 312 is floated and the voltage difference established across each storage capacitor 304 remains constant. Therefore, the input voltage $V_{in}$ of each inversion unit 312 changes according to signals applied to the storage capacitor 304 via the corresponding data line 34. During the sweep period, sweep signals are applied to the data lines 34 and swept in a range including the display signal voltage levels that were already written into the storage capacitors 304 during the writing period. The input voltage $V_{in}$ of each inversion unit 312 increases with the voltage level of the applied sweep signals. When the logic inversion threshold of an inversion unit 312 is reached (designated as T1 in FIG. 6), the output voltage $V_{out}$ of the inverter unit 312 drops sharply to a low level. The corresponding driving TFT 308 begins to conduct, thereby coupling the corresponding OLED 302 to the voltage source VDD1 and allowing the OLED 302 to illuminate. When the voltage level of the sweep voltage drops to a degree so that the input voltage $V_{in}$ of the inversion unit 312 becomes smaller than its logic inversion threshold (designated as T2 in FIG. 6), the output voltage $V_{out}$ of the inverter unit 312 switches back to a high level again. The driving TFT 308 is turned off, thereby disconnecting the OLED 302 from the voltage source VDD1. As a result, the OLED 302 remains illuminant between T1 and T2, which is referred to as the emission period of the pixel 300. Therefore, by modulating the illuminating time of each pixel according to the prewritten display signal voltage and the sweep signals, the pixels 300 can be illuminated at multiple illumination levels.

Figure 7:
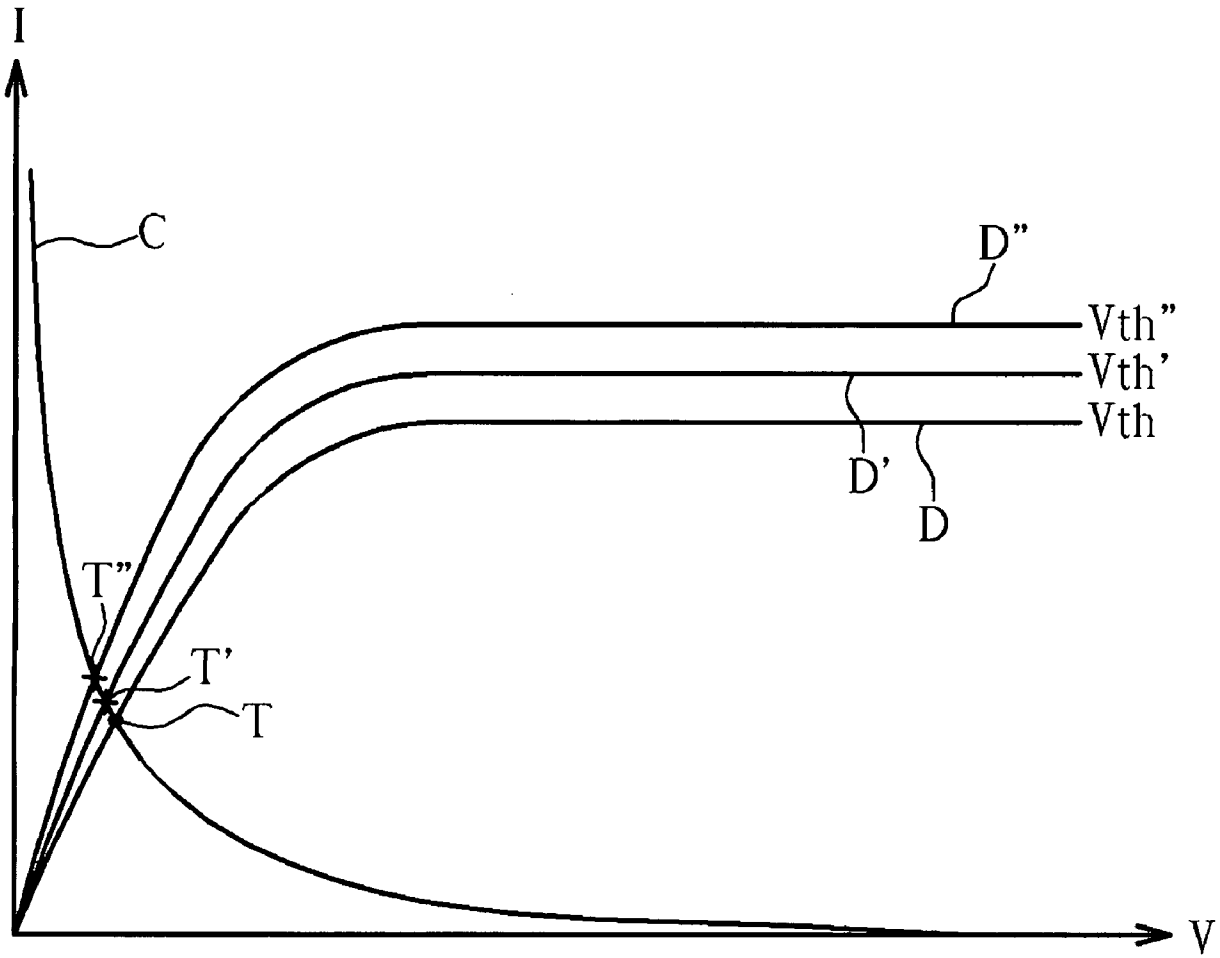
FIG. 7 shows an I-V curve of the driving switch and the OLED in the AMOLED of FIG. 3.

FIG. 7 shows a current-voltage (I-V) curve of the driving TFT 308 and the OLED 302. In contrast to the prior art AMOLED 10 in which the driving TFT 108 works in the saturation region, the driving TFT 308 of the present invention works in the linear region. In FIG. 7, a curve C represents the I-V curve of the OLED 302, a curve D represents the I-V curve of the driving TFT 308 with a nominal threshold voltage Vth, and curves D' and D" represent the I-V curves of the driving TFT 308 when the threshold voltage deviates from the nominal value Vth to Vth' and Vth", respectively. As shown in FIG. 7, the designed operational point T (indicated by "·" in FIG. 7) of the OLED 302 can shift to points T' and T" (indicated by "X" in FIG. 7) with threshold voltage deviations. As represented by the formula (2), since the drain current of a transistor is only slightly dependent on its threshold voltage when working in the linear region, the AMOLED 30 has better display uniformity when the characteristics of the driving TFTs 308 vary.

In order for the driving TFTs 308 to work in the linear region and reduce display mura due to threshold voltage variations, the voltage sources VDD1, VDD2, VEE1 and VEE2 used in the AMOLED 30 have to be set to proper values. In the AMOLED 30, both the voltage sources VDD1 and VDD2 are larger than the voltage sources VEE1 and VEE2, VDD2 is larger or equal to VDD1, and VEE2 is smaller or equal to VEE1. The bias condition of the AMOLED 30 is summarized as follows: VDD2≧VDD1>VEE1≧VEE2. If a same voltage source VEE is used for both the voltage sources VEE1 and VEE2, only three power lines are required for respectively providing power from the voltage sources VDD1, VDD2, and VEE to each pixel 300.

Figure 8:
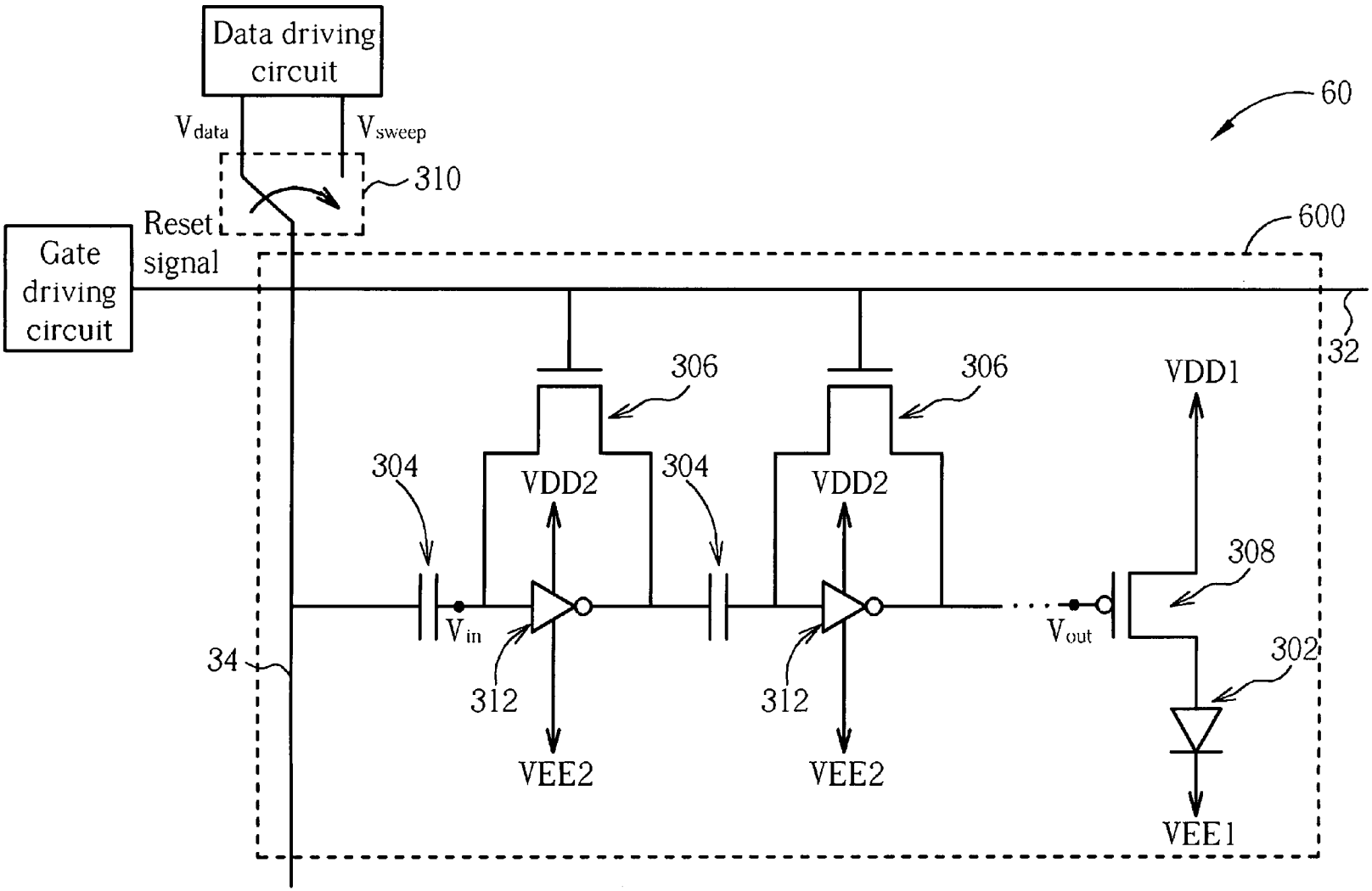
FIG. 8 shows a second embodiment of a system for displaying images that includes an AMOLED.

FIG. 8 shows a second embodiment of a system for displaying images that includes an AMOLED 60. The AMOLED 60 includes a plurality of pixels 600 arranged in a matrix manner, and only one pixel is shown in FIG. 8 for simplicity. The AMOLED 60 differs from the AMOLED 30 in that the AMOLED 60 includes a plurality of storage capacitors 304, reset switches 306, and inversion units 312. The inversion units 312 are coupled in series between the data line 34 and the gate of the driving TFT 308. The voltages established at the input and output ends of the series-coupled inversion units 312 are designated as $V_{in}$ and $V_{out}$, respectively. The voltage sources used in the AMOLED 60 has the following relationship VDD2≧VDD1>VEE1≧VEE2, so that the driving TFT 308 works in the linear region.

Figure 9:
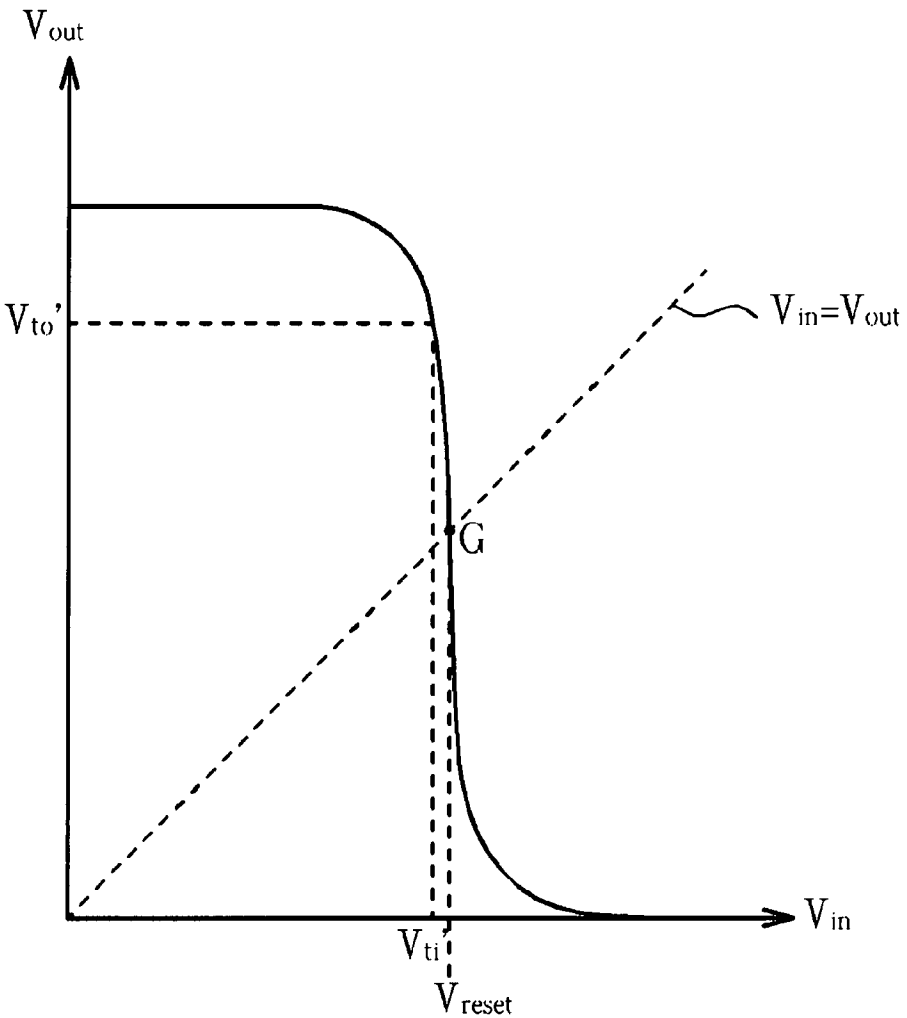
FIG. 9 shows an overall $V_{in}$-$V_{out}$ characteristic of the series-coupled inversion units in the AMOLED of FIG. 8.

FIG. 9 shows an overall $V_{in}$-$V_{out}$ characteristic of the series-coupled inversion units 312 in AMOLED 80. In FIG. 9, a solid curve represents the voltage characteristic, $V_{to}'$ represents a turn-on voltage of the driving TFT 308 obtained at the output end of the series-coupled inversion units 312, and $V_{ti}'$ represents a corresponding input voltage at the same time. Since the AMOLED 60 includes more inversion units 312, $V_{ti}'$ is closer to the ideal logic inversion threshold $V_{reset}$, and the overall Vin-Vout characteristic of the series-coupled inversion units 312 has a sharper slope during the voltage transition period. Therefore, the AMOLED 60 can provide faster switching operations than the AMOLED 30.

Figure 10:
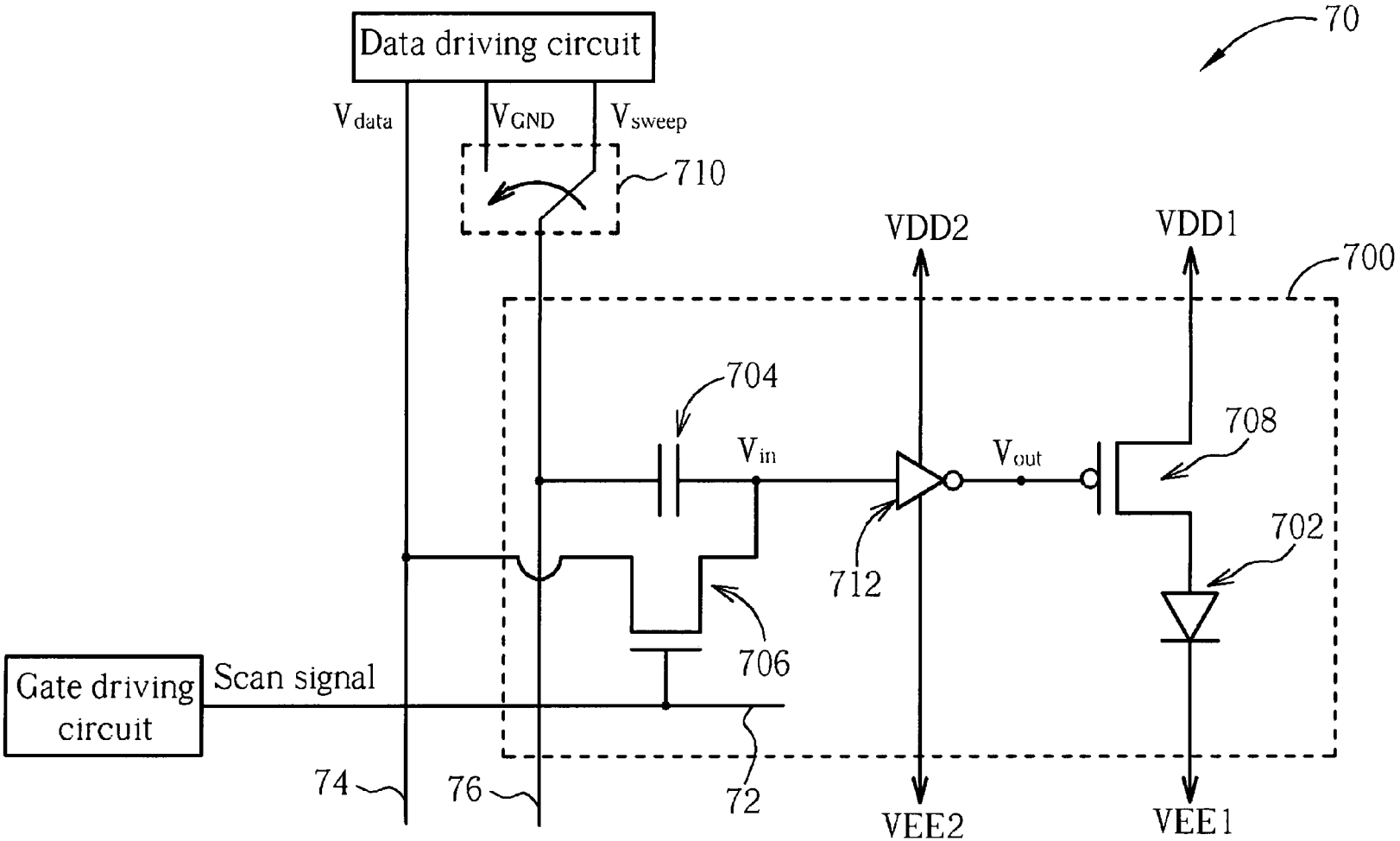
FIG. 10 shows a third embodiment of a system for displaying images that includes an AMOLED.

FIG. 10 shows a third embodiment of a system for displaying images that includes an AMOLED 70. The AMOLED 70 includes a plurality of pixels 700 arranged in a matrix manner, and only one pixel is shown in FIG. 10 for simplicity. The pixels 700, each including an OLED 702 as a pixel light emitting device, are coupled to external driving circuits via a corresponding scan line 72, a data line 74 and a sweep line 76. Each pixel 700 further includes a storage capacitor 704, a control switch 706, a driving TFT 708, a relay switch 710 and an inversion unit 712. The control switch 706, coupled between an input end of the inversion unit 712 and the data line 74, is either turned on or turned off based on scan signals received from the scan line 72. The storage capacitor 704, coupled between the sweep line 76 and the input end of the inversion unit 712, stores charges of sweep signals $V_{sweep}$ via the relay switch 710. The driving TFT 708 can include a p-type TFT having a gate coupled to an output end of the inversion unit 712 and a source coupled to a voltage source VDD1. The OLED 702 is coupled between a drain of the driving TFT 708 and a voltage source VEE1. The voltages established at the input and output ends of the inversion unit 712 are designated as $V_{in}$ and $V_{out}$, respectively. The inversion unit 712 also includes a first and a second supply end coupled to voltage sources VDD2 and VEE2, respectively. The voltage sources used in the AMOLED 70 has the following relationship VDD2□VDD1>VEE1□VEE2 so that the driving TFT 708 works in the linear region. The scan signals can be generated by an external gate driving circuit, such as one commonly known to those skilled in the art, for example, while a constant voltage $V_{GND}$, the data signal $V_{data}$ and the sweep signal $V_{sweep}$ can be generated by an external data driving circuit, such as one commonly known to those skilled in the art, for example. The voltage level of the constant voltage $V_{GND}$ can be set to VDD1, VDD2, VEE1, VEE2, or ground level.

The overall operation of the AMOLED 70 can also be illustrated using FIG. 6. During the writing period, the scan line 72 goes high and turns on the control switch 706 and a predetermined display signal voltage $V_{data}$ is input from the data line 74 into one end of the storage capacitor 704 through the turned-on control switch 706, while the other end of the storage capacitor 704 is coupled to $V_{GND}$. A voltage difference between the display signal voltage $V_{data}$ and $V_{GND}$ is stored in the storage capacitor 704, and the output of the inversion unit 712 remains at a high level. During the driving period, a sweep signal $V_{sweep}$ is fed into the storage capacitor 704 from the sweep line 76 and changes the input voltage $V_{in}$ of the inversion unit 712 accordingly. When the input voltage $V_{in}$ of the inverter circuit 710 exceeds its logic inversion threshold (designated as T1 in FIG. 6), the output voltage $V_{out}$ of the inversion unit 712 drops sharply to a low level. The driving TFT 708 begins to conduct, thereby coupling the OLED 702 to the voltage source VDD1 and allowing the OLED 702 to illuminate. When the voltage level of the sweep voltage drops to a degree so that the input voltage $V_{in}$ of the inversion unit 712 becomes smaller than its logic inversion threshold (designated as T2 in FIG. 6), the output voltage $V_{out}$ of the inverter unit 312 switches back to a high level again. The driving TFT 708 is turned off, thereby disconnecting the OLED 702 from the voltage source VDD1. As a result, the OLED 702 remains illuminant between T1 and T2, which is referred to the emission period of the pixel 700. Therefore, by modulating the illuminating time of each pixel according to the prewritten display signal voltage and the sweep signals, the pixels 700 can be illuminated at multiple illumination levels.

Figure 11:
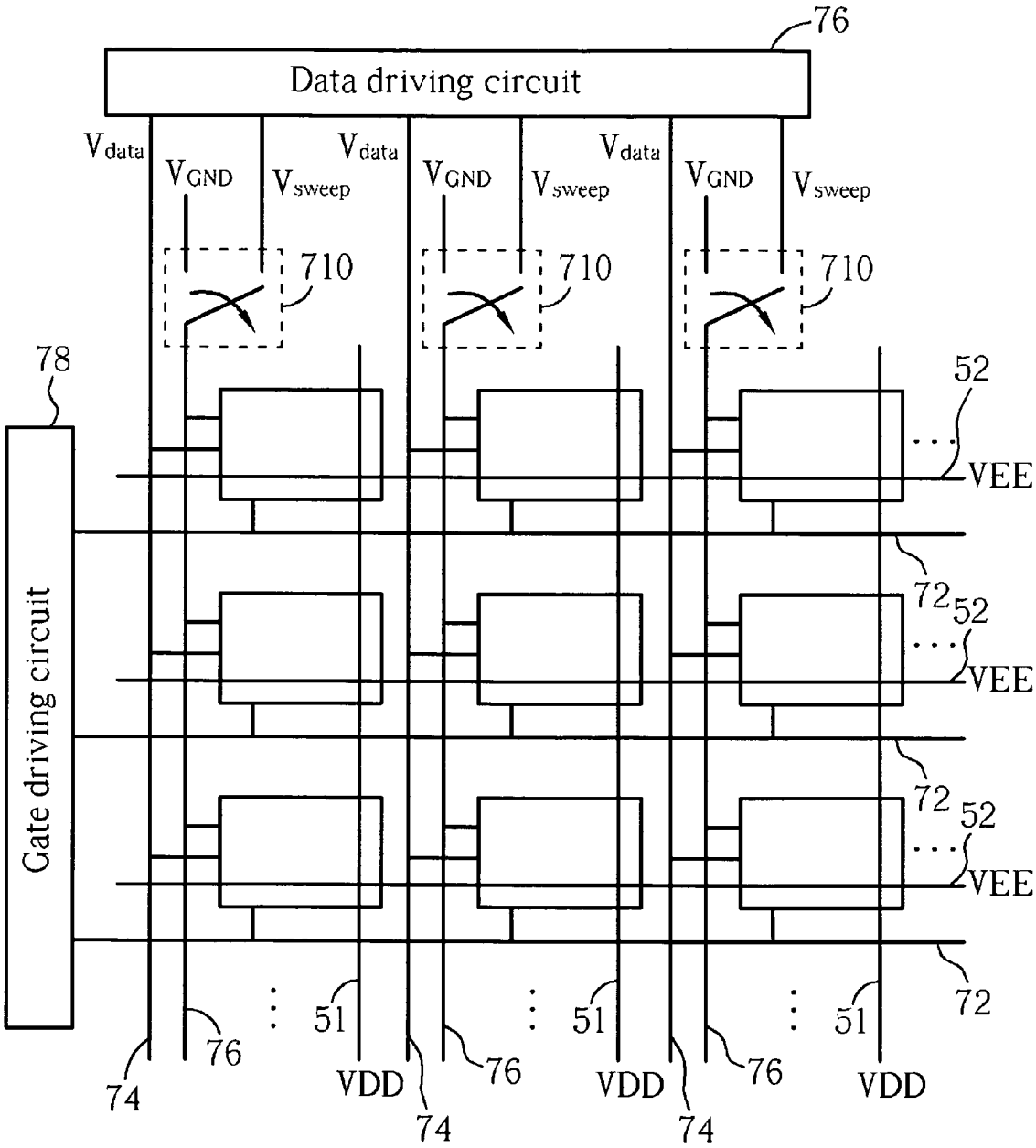
FIG. 11 shows the matrix of the AMOLED of FIG. 10.

FIG. 11 shows the matrix of the AMOLED 70 of the third embodiment of the present invention. The AMOLED 70 shown in FIG. 11 includes a data driving circuit 76, a gate driving circuit 78, a plurality of scan lines 72, a plurality of data lines 74, a plurality of sweep lines 76, and a plurality of pixels 700. In this embodiment, a voltage source VDD is used for both the voltage sources VDD1 and VDD2 and a voltage source VEE is used for both the voltage sources VEE1 and VEE2, wherein VDD is larger then VEE. Power lines 51 and 52 are used to provide power from the voltage sources VDD and VEE to each pixel 700.

Figure 12:
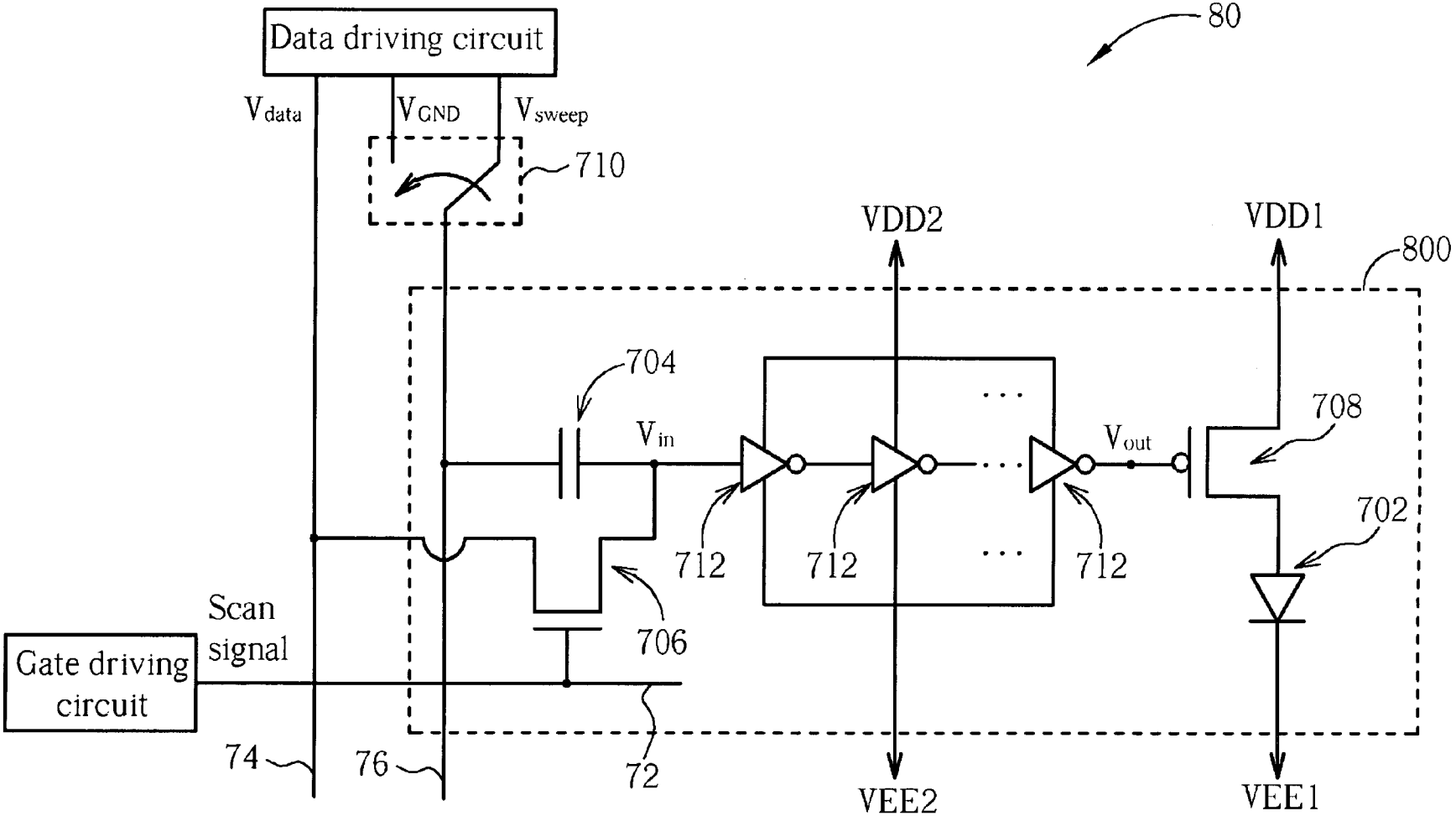
FIG. 12 shows a fourth embodiment of a system for displaying images that includes an AMOLED.

FIG. 12 shows a fourth embodiment of a system for displaying images that includes an AMOLED 80. The AMOLED 80 includes a plurality of pixels 800 arranged in a matrix manner, and only one pixel is shown in FIG. 12 for simplicity. The AMOLED 80 differs from the AMOLED 70 in that the AMOLED 80 includes a plurality of the inversion units 712 coupled in series between the storage capacitor 704 and the gate of the driving TFT 708. The voltage sources used in the AMOLED 80 also has the following relationship VDD2≧VDD1>VEE1≧VEE2, so that the driving TFT 708 works in the linear region. Since the AMOLED 80 includes more inversion units 712, the overall Vin−Vout characteristic of the series-coupled inversion units 712 has a sharper slope during the voltage transition period. Therefore, the AMOLED 80 can provide faster switching operations than the AMOLED 70.

Figure 13:
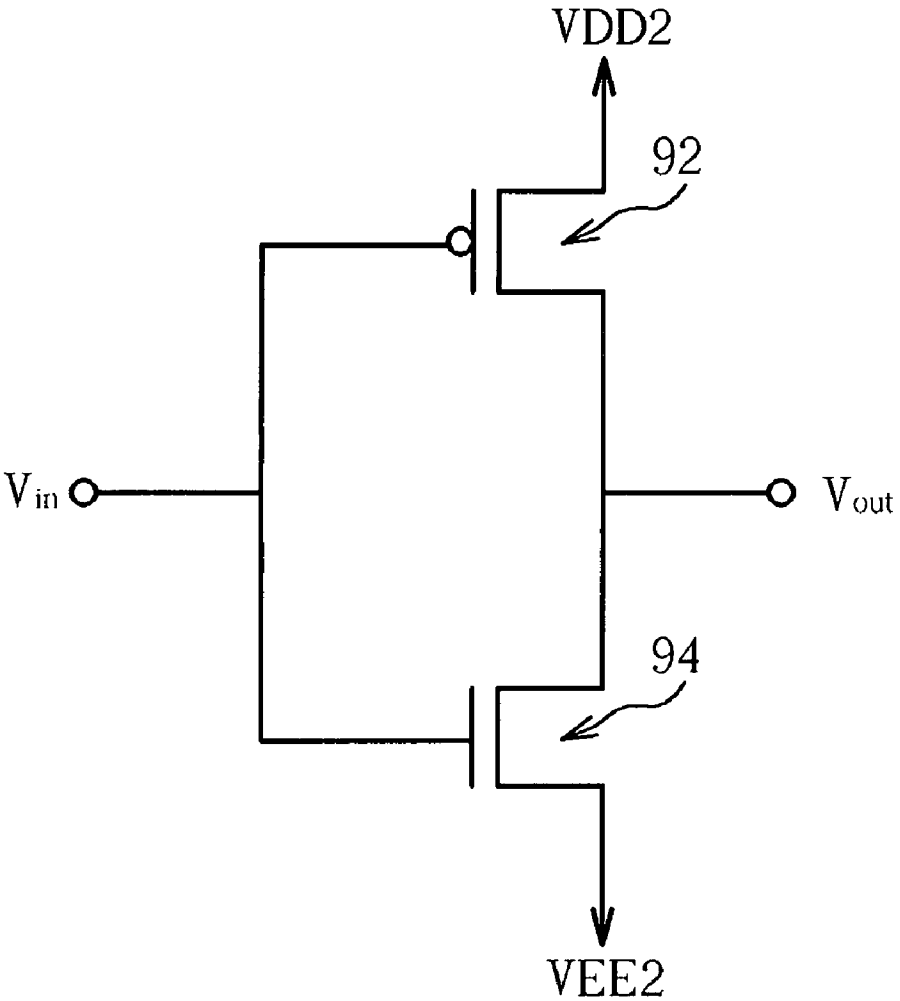
FIG. 13 shows a configuration of the inversion units of the AMOLEDs in FIGS. 3 and 6-8.

FIG. 13 shows a configuration of the inverter units 312 and 712 that can be used in various embodiments, such as those depicted herein. The configuration in FIG. 13 is a typical CMOS (complementary metal oxide semiconductor) inverter comprising a p-type TFT 92 and an n-type TFT 94. The gates of the TFTs 92 and 94 are coupled together to the input end of the inversion unit. The drains of the TFTs 92 and 94 are coupled together to the output end of the inversion unit. The sources of the TFTs 92 and 94 serve as supply ends and are coupled to the voltages VDD2 and VEE2, respectively. Other configurations can also be used for the inversion units 312 and 712.

Figure 14:
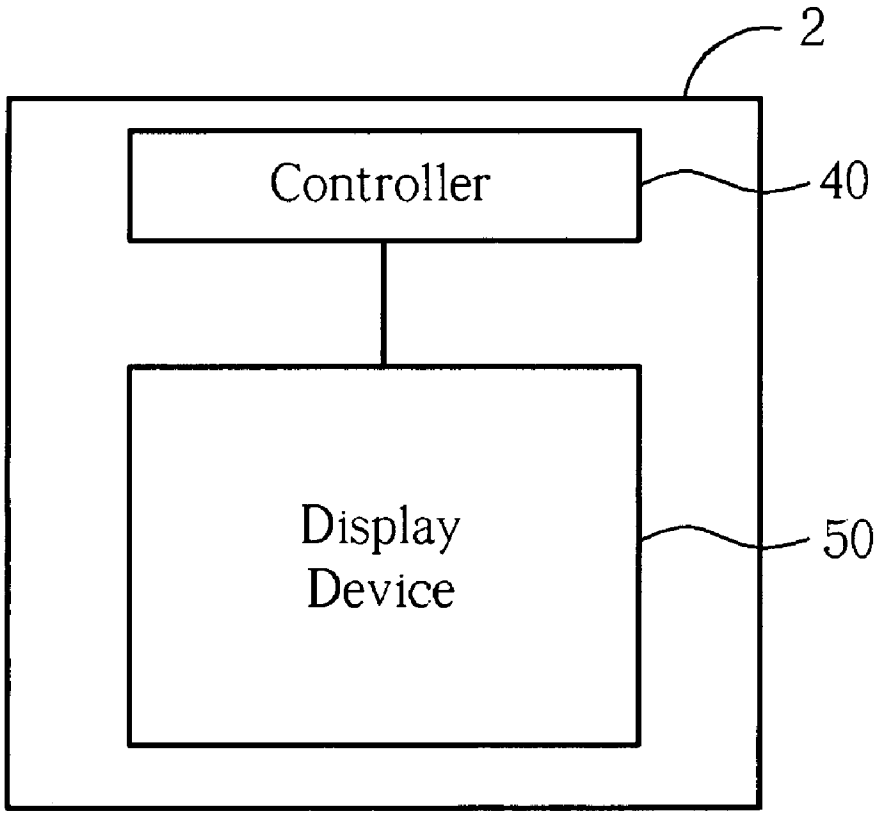
FIG. 14 schematically shows another embodiment of a system for displaying images.

FIG. 14 schematically shows another embodiment of a system for displaying images, which in this case, is implemented as a display device 50 or an electronic device 2. The described active matrix organic electroluminescent device can be incorporated into a display device that can be an AMOLED. As shown in FIG. 14, the display device 50 comprises an active matrix organic electroluminescent device, such as the active matrix organic electroluminescent devices 30, 60, 70 and 80 shown in FIGS. 3, 8, 10 and 12. The display device 50 can form a portion of a variety of electronic devices (in this case, electronic device 2). Generally, the electronic device 2 can comprise the display device 50 and a controller 40. Further, the controller 40 is operatively coupled to the display 50 and provides input signals (e.g., an image signal) to the display device 50 to generate images. The electronic device 2 can be a mobile phone, digital camera, PDA (personal data assistant), notebook computer, desktop computer, television, car display, or portable DVD player, for example.

In the present invention, the OLED luminance is controlled by the sweep voltages and the input data voltages. Two-state OLED driving is implemented based on the on/off states of the corresponding driving TFTs. The driving TFTs operate in the linear region so that display mura due to threshold voltage variations can be reduced. Also, power consumption can be lowered by decreasing the voltages sources used for driving the OLED.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A system for displaying images, comprising:

a display device, comprising:

a data line operative to provide display signals and sweep signals;

a scan reset line operative to provide scan reset signals;

a first capacitor having a first end coupled to the data line, the first capacitor being operative to store charges from the data line;

a first inversion unit having an input end coupled to a second end of the first capacitor, a first supply end coupled to a first voltage source, a second supply end coupled to a second voltage source larger than the first voltage, and an output end;

a second inversion unit having an input end coupled to the output end of the first inversion unit and an output end;

a first reset switch having a first end coupled between the second end of the first capacitor and the input end of the first inversion unit, a second end coupled to the output end of the first inversion unit, and a control end coupled to the scan reset line;

a second reset switch having a first end coupled to the input end of the second inversion unit, a second end coupled to the output end of the second inversion unit, and a control end coupled to the scan reset line;

a driving thin film transistor (TFT) having a control end coupled to the output end of the second inversion unit; and an illuminating unit coupled between a first end of the driving TFT and a third voltage source larger than or equal to the first voltage source.

2. The system of claim 1 wherein a second end of the driving TFT is coupled to a fourth voltage source smaller than or equal to the second voltage source, and larger than the third voltage source.

3. The system of claim 1 wherein a second end of the driving TFT is coupled to the second voltage source.

4. The system of claim 1 further comprising:

a data driving circuit coupled to the data line and operative to generate the display signals and the sweep signals; and a gate driving circuit coupled to the scan reset line and operative to generate the scan reset signals.

5. The system of claim 4 further comprising a relay switch coupled between outputs of the data driving circuit and the data line and operative to control passages of the display signals and the sweep signals into the data line.

6. The system of claim 1 further comprising:

a second capacitor coupled between the output end of the first inversion unit and the input end of the second inversion unit.

7. The system of claim 1 wherein a first supply end of the second inversion unit is coupled to the first voltage source and a second supply end of the second inversion unit is coupled to the second voltage source.

8. The system of claim 1 wherein the second inversion unit includes a complementary metal oxide semiconductor (CMOS) inverter.

9. The system of claim 1 wherein the first inversion unit includes a CMOS inverter.

10. The system as claim 1, further comprising an electronic device, wherein the electronic device comprises:

the display device; and a controller coupled to the display and operative to provide input to the display such that the display displays images.

11. A system for displaying images, comprising:

a first data line operative to provide display signals;

a second data line operative to provide sweep signals;

a scan line operative to provide scan signals;

a control switch having a control end coupled to the scan line, and a first end coupled to the first data line;

a capacitor coupled between the second data line and a second end of the control switch operative to provide charges from the first or second data line;

an inversion unit having an input end coupled to the capacitor, a first supply end coupled to a first voltage source, a second supply end coupled to a second voltage source larger than the first voltage, and an output end;

a driving TFT having a control end coupled to the output end of the inversion unit; and an illuminating unit coupled between a first end of the driving TFT and a third voltage source larger than or equal to the first voltage source.

12. The system of claim 11 wherein a second end of the driving TFT is coupled to a fourth voltage source smaller than or equal to the second voltage source, and larger than the third voltage source.

13. The system of claim 11 wherein a second end of the driving TFT is coupled to the second voltage source.

14. The system of claim 11 further comprising:

a data driving circuit coupled to the first and second data lines operative to provide the display signals, the sweep signals, and a constant voltage; and a gate driving circuit coupled to the scan line operative to provide the scan signals.

15. The system of claim 14 further comprising a relay switch coupled between outputs of the data driving circuit and the second data line operative to provide passages of the display signals and the constant voltage into the second data line.

16. The system of claim 11, further comprising an electronic device, wherein the electronic device comprises:

the display device; and a controller coupled to the display device and operative to provide input to the display device such that the display device displays images.

* * * * *